US011585356B2

(12) United States Patent
Findeisen et al.

(10) Patent No.: US 11,585,356 B2
(45) Date of Patent: Feb. 21, 2023

(54) MOTOR VEHICLE PUMP ARRANGEMENT AND MOUNTING ARRANGEMENT FOR A MOTOR VEHICLE PUMP ARRANGEMENT

(71) Applicant: PIERBURG PUMP TECHNOLOGY GMBH, Neuss (DE)

(72) Inventors: Alexander Findeisen, Doebeln (DE); Wolfgang Zacher, Doebeln (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 0 days.

(21) Appl. No.: 17/287,525

(22) PCT Filed: Oct. 25, 2018

(86) PCT No.: PCT/EP2018/079315
§ 371 (c)(1),
(2) Date: Apr. 22, 2021

(87) PCT Pub. No.: WO2020/083495
PCT Pub. Date: Apr. 30, 2020

(65) Prior Publication Data
US 2021/0388853 A1 Dec. 16, 2021

(51) Int. Cl.
*F04D 29/66* (2006.01)
*F04D 29/60* (2006.01)

(52) U.S. Cl.
CPC ..... *F04D 29/66* (2013.01); *F04D 29/60* (2013.01)

(58) Field of Classification Search
CPC .... F04D 29/669; F04D 29/605; F04D 29/606; F04D 29/628
See application file for complete search history.

(56) References Cited

U.S. PATENT DOCUMENTS 6,174,142 B1 * 1/2001 Holt ..... F04D 29/669 417/423.15
6,685,428 B1 * 2/2004 Freudenberg ..... F04D 29/126 415/174.3
(Continued)

FOREIGN PATENT DOCUMENTS

CN 102410259 A 4/2012
CN 107435675 A 12/2017
(Continued)

*Primary Examiner* — Woody A Lee, Jr.
*Assistant Examiner* — Brian O Peters
(74) *Attorney, Agent, or Firm* — Norman B. Thot

(57) ABSTRACT

A motor vehicle pump arrangement includes a pumping unit having engagement steps, and a mounting arrangement which mounts the pumping unit to a motor vehicle mounting structure which corresponds to the pumping unit. The mounting arrangement includes a vibration-decoupling body having a ring shape, and a clip retainer which is attached to the vibration-decoupling body. The vibration-decoupling body radially surrounds the pumping unit, supports the pumping unit, and is attachable to the motor vehicle mounting structure. The clip retainer axially retains the pumping unit. The clip retainer includes a retainer frame which extends in a transversal pumping unit plane and which is axially supported by the vibration-decoupling body, and retainer arms which axially project from the retainer frame. Each of the retainer arms engages a respective one of the corresponding engagement steps of the pumping unit so as to axially retain the pumping unit.

17 Claims, 3 Drawing Sheets

(56) References Cited

U.S. PATENT DOCUMENTS

| | | | | |
|---|---|---|---|---|
| 6,843,642 | B2 * | 1/2005 | Hung | F04B 39/0044 417/363 |
| 2004/0005227 | A1 | 1/2004 | Cremer et al. | |
| 2005/0058556 | A1 | 3/2005 | Cremer et al. | |
| 2012/0067449 | A1 | 3/2012 | Pesek | |
| 2017/0343153 | A1 | 11/2017 | Yilmaz et al. | |
| 2018/0363659 | A1 * | 12/2018 | Mikkelsen | F04D 29/628 |

FOREIGN PATENT DOCUMENTS

| | | | |
|---|---|---|---|
| CN | 108368851 | A | 8/2018 |
| DE | 10 2016 209 204 | A1 | 11/2017 |
| EP | 1 431 566 | A1 | 6/2004 |
| EP | 2 211 049 | A2 | 7/2010 |
| JP | 2011-27203 | A | 2/2011 |
| WO | WO 2007/118558 | A1 | 10/2007 |

* cited by examiner

MOTOR VEHICLE PUMP ARRANGEMENT AND MOUNTING ARRANGEMENT FOR A MOTOR VEHICLE PUMP ARRANGEMENT

CROSS REFERENCE TO PRIOR APPLICATIONS

This application is a U.S. National Phase application under 35 U.S.C. § 371 of International Application No. PCT/EP2018/079315, filed on Oct. 25, 2018. The International Application was published in English on Apr. 30, 2020 as WO 2020/083495 A1 under PCT Article 21(2).

FIELD

The present invention is directed to a motor vehicle pump arrangement, in particular to motor vehicle pump arrangement with a vibration-decoupling mounting arrangement for mounting the pumping unit to a corresponding motor vehicle mounting structure. The present invention is also directed to such a mounting arrangement for a motor vehicle pump arrangement.

BACKGROUND

Such a pump arrangement comprises a pumping unit, for example, an electric pumping unit, for circulating a fluid within a motor vehicle fluid circuit. The pump arrangement also comprises a mounting arrangement for mounting the pumping unit to a corresponding motor vehicle mounting structure. The mounting arrangement is provided with a vibration-decoupling body which is attachable to the motor vehicle mounting structure and which supports the pumping unit. The vibration-decoupling body is made of a relatively flexible material so that vibrations of the motor vehicle mounting structure, in particular caused by the engine of the motor vehicle, are not transferred into the pumping unit, or are only transferred into the pumping unit in a significantly suppressed manner. This minimizes the failure probability of the pumping unit and improves the lifetime of the pumping unit. The vibration decoupling body also avoids, or at least minimizes, a vibration transfer from the pumping unit via the mounting structure into a motor vehicle frame. This in particular minimizes the passenger compartment noise of the motor vehicle. The decoupling body is typically ring-shaped and radially surrounds as well as supports the pumping unit.

Such a pump arrangement is, for example, described in DE 10 2016 209 204 A1. The ring opening of the vibration-decoupling body is here press-fitted to a corresponding peripheral surface of a pumping unit housing so that the pumping unit is supported by the decoupling body in a force-locked manner. Since the decoupling body must be relatively flexible to provide an efficient vibrational decoupling, the force-locked connection can only support relatively limited axial forces. The pumping unit housing is therefore provided with radially protruding support protrusions which are in axial contact with the decoupling body to provide an additional form-locked axial support of the pumping unit at the decoupling body. The support protrusions are arranged on both axial sides of the decoupling body to provide a support in both axial directions. The decoupling body must, however, be mounted to the pumping unit during the assembly of the pumping unit housing and, in particular, cannot be mounted to a completely assembled pumping unit. The decoupling body mounting step must therefore be integrated into the pumping unit assembly process, which results in a complex assembly of the pump arrangement.

The prior art also describes mounting the decoupling body to a completely assembled pumping unit, wherein the decoupling body is fixed to the pumping unit by screw joints or by an adhesive bonding. However, these fixation methods require additional fixation elements and/or a complex mounting process to attach the decoupling body to the pumping unit. Screw joints between the pumping unit and the vibration-decoupling body can in particular also impair the vibrational-decoupling properties of the pump arrangement.

SUMMARY

An aspect of the present invention is to provide a motor vehicle pump arrangement which provides a reliable vibration-decoupling mounting of the pumping unit and which can be assembled in a simple manner.

In an embodiment, the present invention provides a motor vehicle pump arrangement which includes a pumping unit comprising at least two engagement steps, and a mounting arrangement which is configured to mount the pumping unit to a motor vehicle mounting structure which corresponds to the pumping unit. The mounting arrangement comprises a vibration-decoupling body having a ring shape, and a clip retainer which is attached to the vibration-decoupling body. The vibration-decoupling body is configured to radially surround the pumping unit, to support the pumping unit, and to be attachable to the motor vehicle mounting structure. The clip retainer is configured to axially retain the pumping unit. The clip retainer comprises a retainer frame which extends in a transversal pumping unit plane and which is axially supported by the vibration-decoupling body, and at least two retainer arms which axially project from the retainer frame. Each of the at least two retainer arms are configured to engage a respective one of the at least two corresponding engagement steps of the pumping unit so as to axially retain the pumping unit.

BRIEF DESCRIPTION OF THE DRAWINGS

The present invention is described in greater detail below on the basis of embodiments and of the drawings in which.

DETAILED DESCRIPTION

Figure 1:
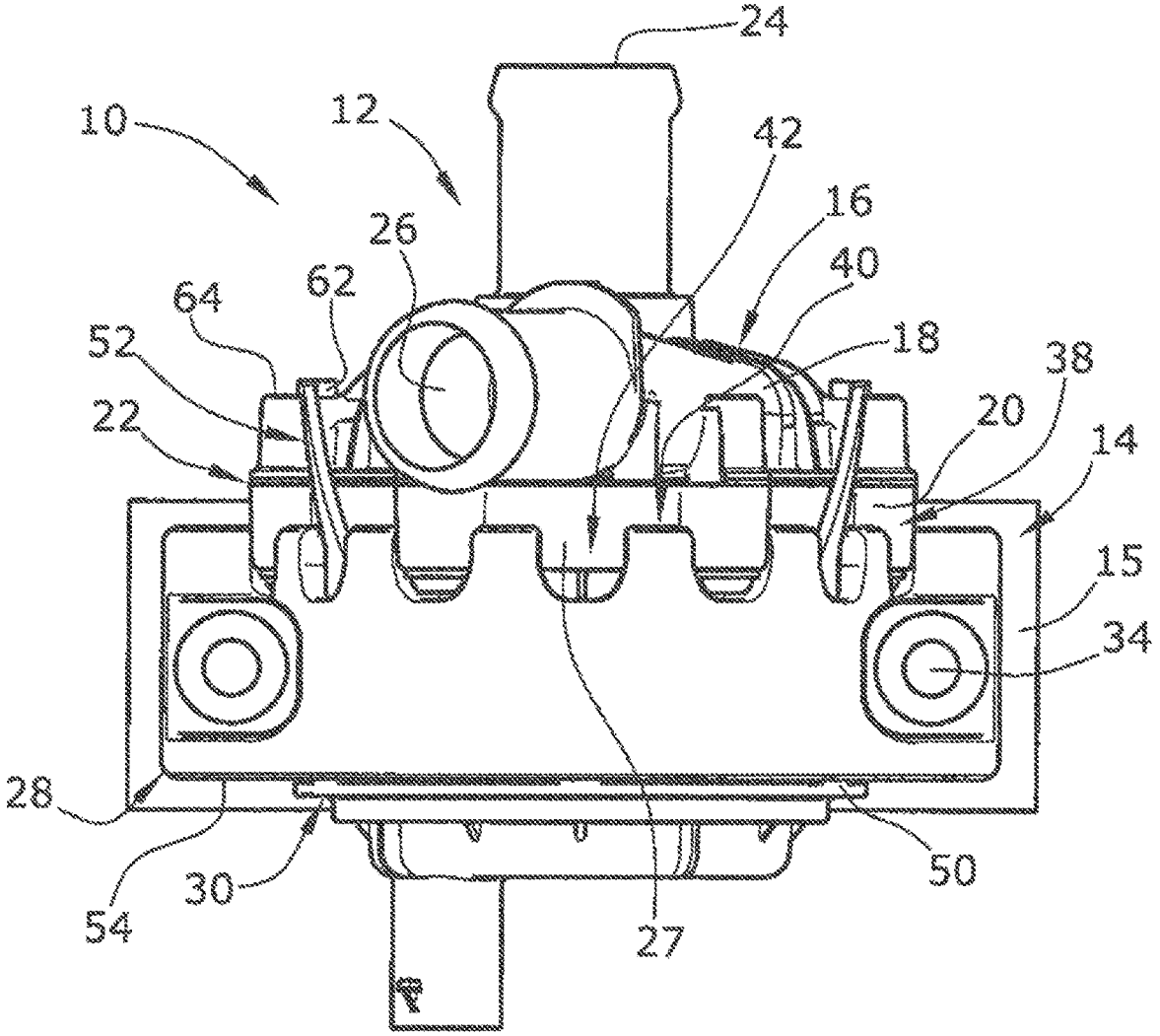
FIG. 1 shows a lateral view of a motor vehicle pump arrangement according to the present invention.
Figure 2:
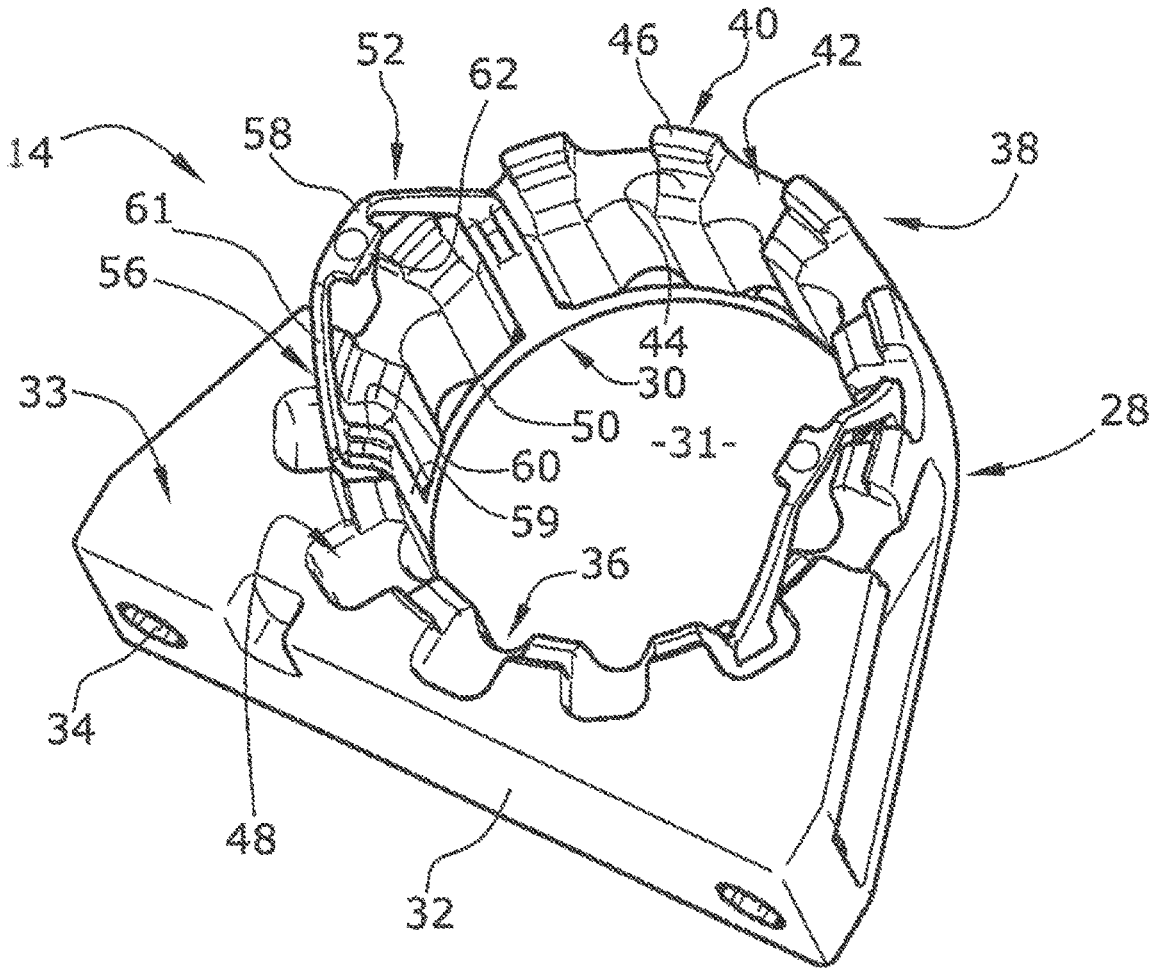
FIG. 2 shows a perspective view of a mounting arrangement of the motor vehicle pump arrangement of FIG. 1.
Figure 3:
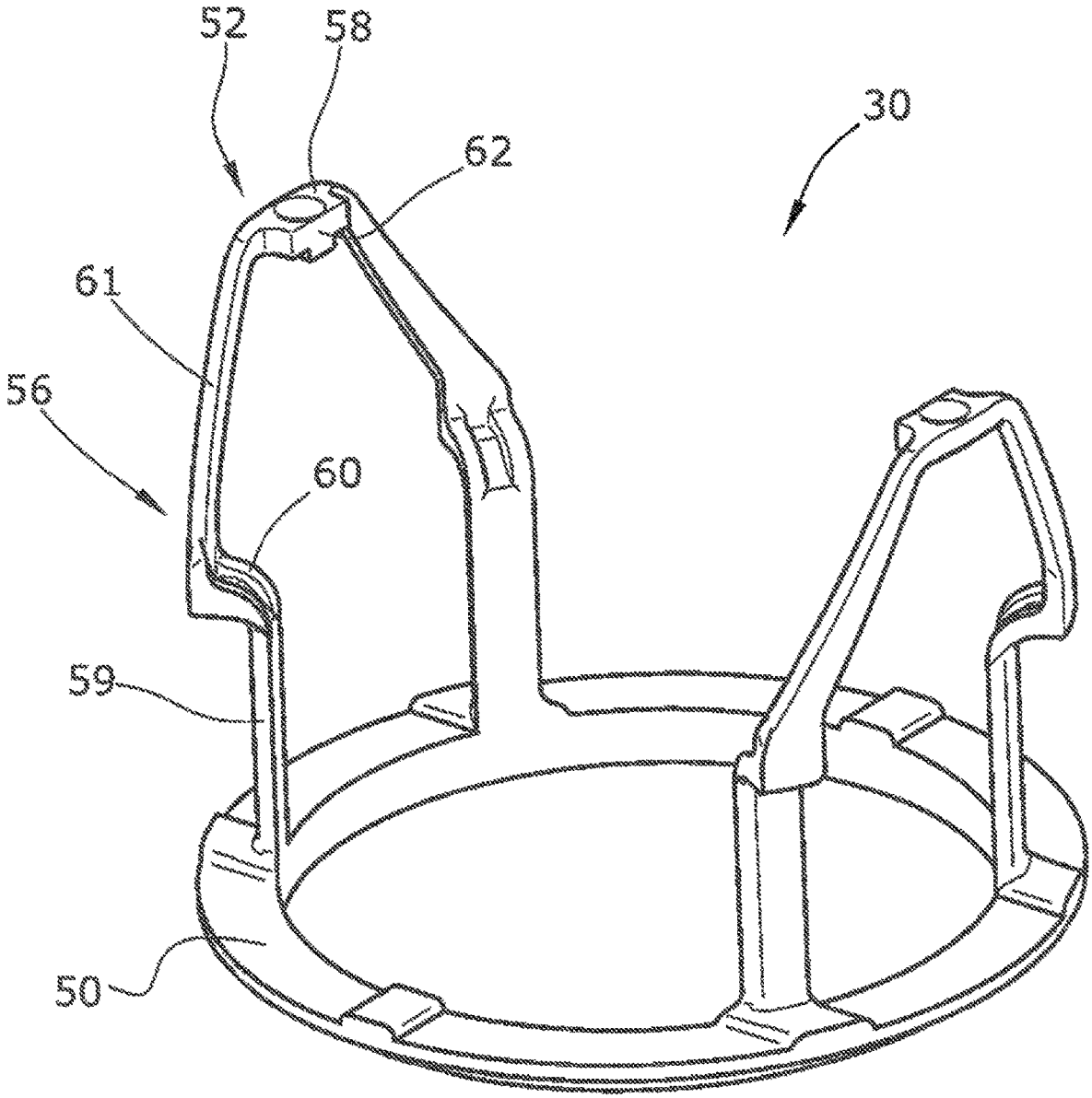
FIG. 3 shows a perspective view of a clip retainer of the mounting arrangement of FIG. 2.

The motor vehicle pump arrangement according to the present invention is provided with a pumping unit for circulating a working fluid within a motor vehicle fluid circuit. The pumping unit can, for example, be electrically driven by an electric motor and can, for example, not be mechanically driven by a motor vehicle engine. The pumping unit can in particular be an electric coolant pump for circulating a coolant within a motor vehicle coolant circuit. In contrast to a mechanically driven pumping unit, the mounting site of an electrically driven pumping unit is relatively freely selectable. Because of the missing mechanical coupling with the engine, vibrations are transferred into the electrically driven pumping unit only via the mounting arrangement.

The motor vehicle pump arrangement according to the present invention is also provided with a mounting arrangement for mounting the pumping unit to a motor vehicle mounting structure. The mounting structure is directly attached to or is defined by the motor vehicle frame or, alternatively, is attached to or is defined by a motor vehicle component, for example, as a motor vehicle engine which is attached to the motor vehicle frame. The mounting arrangement comprises a ring-shaped vibration-decoupling body which extends substantially in a transversal pumping unit plane. The vibration-decoupling body radially surrounds and supports the pumping unit and is attachable to the motor vehicle mounting structure. The vibration-decoupling body can, for example, radially surround the electric motor of the electric pumping unit so that the center of mass of the pumping unit is located within the vibration-decoupling body. The pumping unit is supported at the motor vehicle mounting structure only via the vibration-decoupling body and is in particular not in direct contact with the motor vehicle mounting structure, with the motor vehicle frame, or with the motor vehicle engine. The vibration-decoupling body can, for example, be provided with a circular ring opening, but can alternatively be provided with any other transversal ring opening shape. The ring opening shape in any case corresponds with the shape of the pumping unit section being surrounded by the vibration-decoupling body so that the pumping unit is radially supported by the vibration-decoupling body substantially along the entire circumference. The vibration-decoupling body can, for example, also axially support the pumping unit in, for example, a downwardly-directed, first axial direction. The vibration-decoupling body is made of a relatively soft and elastic material, for example, of rubber, silicone, SEBS, EPDM, or of any other elastomer, so that the vibration-decoupling body can efficiently compensate vibrations. The vibration-decoupling body can, for example, be provided with a hardness in the range of 30-70 IRHD, for example, with a hardness in the range of 30-40 IRHD. As a result, the vibrations are not transferred into the pumping unit, or are at least only transferred into the pumping unit in a significantly suppressed manner.

According to the present invention, the mounting arrangement also comprises a clip retainer which is attached to the vibration-decoupling body and which axially retains the pumping unit in a second axial direction which is opposite to the first axial direction. The clip retainer can, for example, be made of plastic and can, for example, be attached to the vibration-decoupling body in a form-locked manner. The clip retainer is provided with a retainer frame which extends substantially in a transversal pumping unit plane and which is axially supported by the vibration-decoupling body. The retainer frame provides a large transversal contact area between the clip retainer and the vibration-decoupling body and, as a result, provides a reliable axial support of the clip retainer. The retainer frame can, for example, be in axial contact with a transversal bottom side of the vibration-decoupling body.

The clip retainer is also provided with at least two retainer arms which axially project from the retainer frame into the second axial direction. The retainer arms are arranged along the circumference of the pumping unit, for example, with a uniform angular distance, and engage corresponding engagement steps of the pumping unit to axially retain the pumping unit in the second axial direction. The retainer arms in particular engage an axial side of the engagement step that faces away from the vibration-decoupling body. The retainer arms are provided to be relatively flexible so that they can be elastically deformed, in particular radially, to allow an axial insertion of the pumping unit into the clip retainer during the assembly of the motor vehicle pump arrangement. In the final position, the pumping unit is axially supported in the first axial direction, for example, by the vibration-decoupling body or, alternatively, by the retainer frame, and is axially supported in the opposite second axial direction by the retainer arms which engage the engagement steps of the pumping unit housing.

The mounting arrangement according to the present invention provides a simple assembly of the motor vehicle pump arrangement, wherein the clip retainer provides a reliable attachment of the pumping unit to the vibration-decoupling body which does not require any complex fixation process and/or additional fixation elements. The mounting arrangement with the relatively soft vibration-decoupling body and with the flexible clip retainer also provides an efficient vibration-decoupling between the motor vehicle and the pumping unit.

The clip retainer can, for example, be made of a thermoplastic, which is also referred to as thermosoftening plastic. The clip retainer can, for example, be made of a reinforced thermoplastic and can in particular be made of a thermoplastic which is reinforced with glass balls. The clip retainer can, for example, be made of a glass-ball-reinforced polyamide. The thermoplastic clip retainer provides a relatively high flexibility combined with a relatively high strength. The thermoplastic clip retainer thereby allows for a simple insertion of the pumping unit into the clip retainer and also provides a robust and reliable axial retaining of the pumping unit.

In an embodiment of the present invention, the retainer arms can, for example, extend axially through the vibration-decoupling body, for example, through the ring opening of the ring-shaped vibration-decoupling body. The retainer arms and thereby the clip retainer are as a result supported radially outwardly by the vibration-decoupling body so that no additional support elements are required to provide a reliable attachment of the clip retainer to the vibration-decoupling body. The retainer arms can, for example, be radially clamped between the radial inside of the vibration-decoupling body and the radial outside of the pumping unit housing. This provides a relatively compact motor vehicle pump arrangement and provides a reliable attachment of the pumping unit.

The vibration-decoupling body can, for example, be provided with at least two retainer recesses into which the at least two retainer arms engage. The retainer recesses can be provided at an axial surface and/or at a radially inner surface of the vibration-decoupling body. The engaged retainer arms are in any case circumferentially enclosed by the vibration-decoupling body so that the clip retainer cannot rotate within the vibration-decoupling body. The retainer recesses allow the retainer clip to be provided with a defined and stable rotational orientation with respect to the vibration-decoupling body which does not require any separate positioning elements.

In an embodiment of the present invention, the vibration-decoupling body can, for example, be provided with a flange portion which extends in a longitudinal pumping unit plane and which is attachable to the motor vehicle mounting structure. The flange portion can, for example, be provided with screw holes so that the vibration-decoupling body can be attached to the motor vehicle mounting structure via a simple and robust screw joint. The flange portion provides a large contact area between the vibration-decoupling body and the motor vehicle mounting structure and, as a result, provides a robust and reliable attachment of the motor vehicle pump arrangement to the motor vehicle mounting structure.

Each retainer arm can, for example, be provided with a radially inwardly directed snap element which engages the corresponding engagement step of the pumping unit and which axially retains the pumping unit. The snap element can, for example, be provided integrally with the retainer arms, but can alternatively be provided as a separate body which is fixed to the retainer arm. The snap element can, for example, be arranged at a retainer-frame-remote axial end of the retainer arm. The snap element is provided to be relatively rigid and provides a relatively large-area contact with the engagement step so that the snap element provides a reliable axial retaining of the pumping unit.

In an embodiment of the present invention, each retainer arm can, for example, be provided with a support section which extends in a transversal plane and which is axially supported by the vibration-decoupling body. The support section is provided axially spaced from the retainer frame. The support section and the retainer ring are in axial contact with opposite axial sides of the vibration-decoupling body so that the retainer ring is attached to the vibration-decoupling body in a form-fitting manner. No additional fixation elements are therefore required for the fixation of the clip retainer to the vibration-decoupling body. This provides a simple and compact motor vehicle pump arrangement.

Each retainer arm can, for example, be substantially U shaped with two axially extending support legs and with a laterally extending connection leg laterally connecting the support legs. The pumping unit can, for example, be provided with corresponding radially protruding support protrusions, for example, screw sockets of the pumping unit housing, which engage between the two support legs so that the support legs enclose the support protrusion on both lateral sides and so that the connection leg encloses the support protrusion on an axial side. This provides a robust connection between the clip retainer and the pumping unit and, as a result, provides a reliable attachment of the pumping unit to the vibration-decoupling body.

The connection leg can, for example, be located at a support-ring-remote axial end of the support legs and can, for example, be provided with the snap element so that the snap element is located at an axial end of the retainer arm. The U-shaped retainer arm with the snap element provides a reliable and robust retaining of the pumping unit.

In an embodiment of the present invention, the retainer frame can, for example, be ring-shaped and radially surround the pumping unit. The ring-shaped retainer frame provides a relatively homogeneous and large-area axial support of the retainer frame at the vibration-decoupling body.

The pumping unit housing typically comprises two housing bodies which are axially screwed to each other, wherein the screw sockets are located at the radial outside of the pumping unit housing. The engagement step can, for example, be defined by a screw socket of a pumping unit housing, in particular by a transversal surface of the screw socket, so that no structural adaption of the pumping unit housing is required to provide the engagement step.

In an embodiment of the present invention, an axial side of the vibration-decoupling body can, for example, be provided with a castellated structure which comprises several axially extending merlons. The merlons of the castellated structure can, for example, be disposed along the circumference of the vibration-decoupling body with a uniform angular distance so as to define several pump receptacles therebetween. In the mounted state of the pump arrangement, the screw sockets of the pumping unit housing engage some of the pump receptacles so that the pumping unit cannot rotate within the vibration-decoupling body. The pumping unit is as a result provided with a defined and stable rotational orientation with respect to the vibration-decoupling body and, as a result, with respect to the motor vehicle mounting structure. The number of pump receptacles can, for example, be higher than the number of screw sockets engaging the pump receptacles. This allows for a mounting of the pumping unit with several different defined rotational orientations with respect to the vibration-decoupling body in simple manner which does not in particular require any structural adaptation of the pumping unit and/or the mounting arrangement.

An embodiment of the present invention is described below under reference to the enclosed drawings.

The described motor vehicle pump arrangement 10 according to the present invention comprises an electric pumping unit 12 and a mounting arrangement 14 for mounting the pumping unit 12 to a corresponding motor vehicle mounting structure 15 which can, for example, be defined by a motor vehicle frame or by a motor vehicle engine.

The pumping unit 12 is provided with a pumping unit housing 16 which comprises a volute housing body 18 and a motor housing body 20. The volute housing body 18 and the motor housing body 20 are axially attached to each other by several screws which are arranged in corresponding screw sockets 22. The pumping unit housing 16 is provided with a ring-shaped transversal support platform 27. The screw sockets 22 are arranged at the radial outside of the pumping unit housing 16 and radially protrude from the support platform 27. The pumping unit 12 is provided with an axial pump inlet 24 and with a radial pump outlet 26.

The mounting arrangement 14 comprises a substantially ring-shaped vibration-decoupling body 28 and a plastic clip retainer 30 which is attached to the vibration-decoupling body 28 and which axially retains the pumping unit 12.

The vibration-decoupling body 28 is made of a relatively soft and elastic material and is provided with a substantially circular ring opening 31. In the shown embodiment of the present invention, the vibration-decoupling body 28 is made of rubber with a hardness in the range of 30-40 IRHD. The vibration-decoupling body 28 radially surrounds and supports the pumping unit 12. The vibration-decoupling body 28 in particular radially surrounds the motor housing body 20 containing the relatively heavy-weight electric motor (which is not shown in the drawings) of the pumping unit 12 so that the center of mass of the pumping unit 12 is located within the axial extent of the vibration-decoupling body 28. The radial inside of the ring opening 31 of the vibration-decoupling body 28 is provided with several retainer recesses 36 which are disposed along the inner circumference of the ring opening 31 with a uniform angular distance.

The axial top side of the vibration-decoupling body 28 which faces the volute housing body 18 is provided with a castellated structure 38 comprising several axially extending merlons 40. The merlons 40 are disposed along the circumference of the ring opening 31 with a uniform angular distance and define several pump receptacles 42 between them. The pump receptacles 42 are provided at the same circumferential positions as the retainer recesses 36 so that the pump receptacles 42 and the retainer recesses 36 merge each other. Each merlon 40 is provided with a substantially L-shaped radial cross section and comprises a substantially transversal pump support pedestal 44 as well as a rotation-locking tongue 46 which axially projects from the radially outer rim region of the pump support pedestal 44.

The vibration-decoupling body 28 is provided with a frame mount portion 33 which partially radially surrounds the ring opening 31 and which defines a flange portion 32 which extends substantially in a longitudinal pumping unit plane. The flange portion 32 is provided with two screw holes 34 so that the vibration-decoupling body 28 is attachable to the motor vehicle mounting structure 15 via a screw joint. The frame mount portion 33 is provided with several pump mounting pockets 48 which circumferentially define the pump receptacles 42 and, as a result, the merlons 40 within the extent of the frame mount portion 33.

In the shown embodiment of the present invention, the clip retainer 30 is made of a glass-ball-reinforced polyamide. The clip retainer 30 comprises a ring-shaped retainer frame 50 and two retainer arms 52 which axially project from the retainer frame 50 and which extend through the ring opening 31 of the vibration-decoupling body 28. The retainer frame 50 radially surrounds the pumping unit 12, and is axially supported by a transversal bottom face 54 located at a volute-housing-body-remote axial bottom side of the vibration-decoupling body 28.

Each retainer arm 52 is provided to be substantially U-shaped and comprises two substantially axially extending support legs 56 which are laterally connected by a substantially laterally extending connection leg 58. Each support leg 56 comprises three support leg sections: a first axial support leg section 59, a radially extending support section 60, and a second axial support leg section 61. The first axial support leg section 59 extends in an upward axial direction starting from the retainer frame 50. The support section 60 extends radially outwardly starting from a retainer-frame-remote axial end of the first axial support leg section 59. The second axial support leg section 61 extends in an upward axial direction starting from the radial outer end of the support section 60. The support section 60 is axially located approximately at half the axial height of the support leg 56. The support section 60 is in particular located axially spaced from the retainer frame 50. The connection leg 58 is attached to a retainer-frame-remote axial end of the second axial support leg section 61. Each retainer arm 52 is also provided with a snap element 62 which is arranged at the radial inside of the connection leg 58 and which extends radially inwardly starting from the connection leg 58.

Each first axial support leg section 59 of the retainer arms 52 engages a corresponding retainer recess 36 of the vibration-decoupling body 28 so that each first axial support leg section 59 is supported at the radial outside and at both lateral sides by the vibration-decoupling body 28. Each support section 60 of the retainer arms 52 engages a corresponding pump receptacle 42 of the vibration-decoupling body 28 so that each support section 60 is supported at the bottom axial side and at both lateral sides by the vibration-decoupling body 28.

The clip retainer 30 is radially supported by the vibration-decoupling body 28 via the first axial support leg sections 59. The clip retainer 30 is axially supported by the vibration-decoupling body 28 in both axial directions, wherein the clip retainer 30 is supported in the downward axial direction via the support sections 60 and in the upward axial direction via the retainer frame 50. Because of the engagement of the support legs 56 with the retainer recesses 36 and the pump receptacles 42, the clip retainer 30 is also provided with a defined and stable rotational orientation with respect to the vibration-decoupling body 28.

The pumping unit 12 is radially supported by the radial inside of the ring opening 31 of the vibration-decoupling body 28, and is axially supported in the downward axial direction by the pump support pedestals 44 of the merlons 40. The snap elements 62 of the retainer arms 52 engage corresponding engagement steps 64 of the pumping unit 12, wherein each engagement step 64 is defined by a topside surface of a screw socket 22. The pumping unit 12 is as a result axially retained in the upward axial direction by the snap elements 62 of the retainer arms 52.

The screw sockets 22 of the pumping unit 12 engage corresponding pump receptacles 42 so that the screw sockets 22 are at least partially enclosed at both lateral sides by the rotation-locking tongues 46 of the two adjacent merlons 40. The pumping unit 12 is as a result provided with a defined and stable rotational orientation with respect to the vibration-decoupling body 28.

The vibration-decoupling body 28 is provided with a larger number of retainer recesses 36 and pump receptacles 42 compared to the number of support legs 56 of the retainer arms 52 as well as compared to the number of screw socket 22 of the pumping unit 12. The angular distance between circumferentially adjacent screw sockets 22 as well as the angular distance between circumferentially adjacent first axial support leg sections 59 is an integral multiple of the angular distance between circumferentially adjacent pump receptacles 42. The pumping unit 12 and the clip retainer 30 can as a result be mounted to the vibration-decoupling body 28 with several different defined and stable rotational orientations in a simple manner, in particular without requiring any structural adaptations of the vibration-decoupling body 28 and/or the pumping unit housing 16.

The present invention is not limited to embodiments described herein; reference should be had to the appended claims.

LIST OF REFERENCE NUMERALS

10 motor vehicle pump arrangement
12 pumping unit
14 mounting arrangement
15 motor vehicle mounting structure
16 pumping unit housing
18 volute housing body
20 motor housing body
22 screw sockets
24 pump inlet
26 pump outlet
27 support platform
28 vibration-decoupling body
30 clip retainer
31 ring opening
32 flange portion
33 frame mount portion
34 screw holes
36 retainer recesses
38 castellated structure
40 merlons
42 pump receptacles
44 pump support pedestals
46 rotation-locking tongues
48 pump mounting pockets
50 retainer frame
52 retainer arms
54 bottom face
56 support legs
58 connection leg

59 first axial support leg section
60 support section
61 second axial support leg section
62 snap element
64 engagement steps

What is claimed is:

1. A motor vehicle pump arrangement comprising:

a pumping unit comprising at least two engagement steps; and a mounting arrangement which is configured to mount the pumping unit to a motor vehicle mounting structure which corresponds to the pumping unit, the mounting arrangement comprising, a vibration-decoupling body having a ring shape, the vibration-decoupling body being configured to radially surround the pumping unit, to support the pumping unit, and to be attachable to the motor vehicle mounting structure, and a clip retainer which is attached to the vibration-decoupling body, the clip retainer being configured to axially retain the pumping unit, the clip retainer comprising, a retainer frame which extends in a transversal pumping unit plane and which is axially supported by the vibration-decoupling body, and at least two retainer arms which axially project from the retainer frame, each of the at least two retainer arms being configured to engage a respective one of the at least two corresponding engagement steps of the pumping unit so as to axially retain the pumping unit, wherein, each of the at least two retainer arms comprises a radially inwardly directed snap element which is configured to engage with one of the at least two engagement steps of the pumping unit so as to axially retain the pumping unit.

2. The motor vehicle pump arrangement as recited in claim 1, wherein the clip retainer is made of a thermoplastic.

3. The motor vehicle pump arrangement as recited in claim 2, wherein the thermoplastic is a glass-ball-reinforced thermoplastic.

4. The motor vehicle pump arrangement as recited in claim 1, wherein each of the at least two retainer arms are further configured to axially extend through the vibration-decoupling body.

5. The motor vehicle pump arrangement as recited in claim 1, wherein, the vibration-decoupling body comprises at least two retainer recesses, and each of the at least two retainer arms are further configured to engage into a respective one of the at least two retainer recesses.

6. The motor vehicle pump arrangement as recited in claim 1, wherein the vibration-decoupling body comprises a flange portion which extends in a longitudinal pumping unit plane and which is configured to be attachable to the motor vehicle mounting structure.

7. The motor vehicle pump arrangement as recited in claim 1, wherein each of the at least two retainer arms is substantially U shaped and further comprises two axially extending support legs and a laterally extending connection leg which laterally connects the support legs.

8. The motor vehicle pump arrangement as recited in claim 7, wherein, the laterally extending connection leg is located at an end of the two axially extending support legs which is remote from the retainer frame, and the radially inwardly directed snap element is arranged at the laterally extending connection leg.

9. The motor vehicle pump arrangement as recited in claim 1, wherein each of the at least two retainer arms comprises a support section which extends in a transversal plane and which is axially supported by the vibration-decoupling body.

10. The motor vehicle pump arrangement as recited in claim 1, wherein, the retainer frame has a ring-shape, and the retainer frame is configured to radially surround the pumping unit.

11. The motor vehicle pump arrangement as recited in claim 1, wherein, the pumping unit further comprises a pumping unit housing, the pumping unit housing comprises screw sockets, and each of the at least two engagement steps is defined by one of the screw sockets of the pumping unit housing.

12. The motor vehicle pump arrangement as recited in claim 11, wherein, an axial side of the vibration-decoupling body comprises a castellated structure which comprises a plurality of axially extending merlons which define a plurality of pump receptacles, a respective one of the plurality of pump receptacles being arranged between a neighboring two of the plurality of axially extending merlons, and each of the screw sockets of the pumping unit housing being configured to engage one the plurality of pump receptacles, respectively.

13. A mounting arrangement for the motor vehicle pump arrangement as recited in claim 1.

14. A motor vehicle pump arrangement comprising:

a pumping unit comprising at least two engagement steps; and a mounting arrangement which is configured to mount the pumping unit to a motor vehicle mounting structure which corresponds to the pumping unit, the mounting arrangement comprising, a vibration-decoupling body having a ring shape, the vibration-decoupling body being configured to radially surround the pumping unit, to support the pumping unit, and to be attachable to the motor vehicle mounting structure, and a clip retainer which is attached to the vibration-decoupling body, the clip retainer being configured to axially retain the pumping unit, the clip retainer comprising, a retainer frame which extends in a transversal pumping unit plane and which is axially supported by the vibration-decoupling body, and at least two retainer arms which axially project from the retainer frame, each of the at least two retainer arms being configured to engage a respective one of the at least two corresponding engagement steps of the pumping unit so as to axially retain the pumping unit, wherein, the vibration-decoupling body comprises a flange portion which extends in a longitudinal pumping unit plane and which is configured to be attachable to the motor vehicle mounting structure.

15. A motor vehicle pump arrangement comprising:

a pumping unit comprising at least two engagement steps; and a mounting arrangement which is configured to mount the pumping unit to a motor vehicle mounting structure which corresponds to the pumping unit, the mounting arrangement comprising, a vibration-decoupling body having a ring shape, the vibration-decoupling body being configured to radially surround the pumping unit, to support the pumping unit, and to be attachable to the motor vehicle mounting structure, and a clip retainer which is attached to the vibration-decoupling body, the clip retainer being configured to axially retain the pumping unit, the clip retainer comprising, a retainer frame which extends in a transversal pumping unit plane and which is axially supported by the vibration-decoupling body, and at least two retainer arms which axially project from the retainer frame, each of the at least two retainer arms being configured to engage a respective one of the at least two corresponding engagement steps of the pumping unit so as to axially retain the pumping unit, wherein, the vibration-decoupling body comprises at least two retainer recesses, and each of the at least two retainer arms are further configured to engage into a respective one of the at least two retainer recesses.

16. A motor vehicle pump arrangement comprising:

a pumping unit comprising at least two engagement steps; and a mounting arrangement which is configured to mount the pumping unit to a motor vehicle mounting structure which corresponds to the pumping unit, the mounting arrangement comprising, a vibration-decoupling body having a ring shape, the vibration-decoupling body being configured to radially surround the pumping unit, to support the pumping unit, and to be attachable to the motor vehicle mounting structure, and a clip retainer which is attached to the vibration-decoupling body, the clip retainer being configured to axially retain the pumping unit, the clip retainer comprising, a retainer frame which extends in a transversal pumping unit plane and which is axially supported by the vibration-decoupling body, and at least two retainer arms which axially project from the retainer frame, each of the at least two retainer arms being configured to engage a respective one of the at least two corresponding engagement steps of the pumping unit so as to axially retain the pumping unit, wherein, each of the at least two retainer arms comprises a support section which extends in a transversal plane and which is axially supported by the vibration-decoupling body.

17. A motor vehicle pump arrangement comprising:

a pumping unit comprising at least two engagement steps and a pumping unit housing, wherein, the pumping unit housing comprises screw sockets, and each of the at least two engagement steps is defined by one of the screw sockets of the pumping unit housing; and a mounting arrangement which is configured to mount the pumping unit to a motor vehicle mounting structure which corresponds to the pumping unit, the mounting arrangement comprising, a vibration-decoupling body having a ring shape, the vibration-decoupling body being configured to radially surround the pumping unit, to support the pumping unit, and to be attachable to the motor vehicle mounting structure, wherein, an axial side of the vibration-decoupling body comprises a castellated structure which comprises a plurality of axially extending merlons which define a plurality of pump receptacles, a respective one of the plurality of pump receptacles being arranged between a neighboring two of the plurality of axially extending merlons, and each of the screw sockets of the pumping unit housing being configured to engage one the plurality of pump receptacles, respectively, and a clip retainer which is attached to the vibration-decoupling body, the clip retainer being configured to axially retain the pumping unit, the clip retainer comprising, a retainer frame which extends in a transversal pumping unit plane and which is axially supported by the vibration-decoupling body, and at least two retainer arms which axially project from the retainer frame, each of the at least two retainer arms being configured to engage a respective one of the at least two corresponding engagement steps of the pumping unit so as to axially retain the pumping unit.

* * * * *